US005427169A

United States Patent [19]

Saulters

[11] Patent Number: 5,427,169

[45] Date of Patent: Jun. 27, 1995

[54] FLEXIBLE GARAGE DOOR SCREEN

[76] Inventor: Wade E. Saulters, 16006 W. 130th St., Strongsville, Ohio 44136

[21] Appl. No.: 97,671

[22] Filed: Jul. 27, 1993

[51] Int. Cl.[6] ..... E06B 3/00

[52] U.S. Cl. ..... 160/368.1; 160/332; 160/DIG. 18

[58] Field of Search ..... 160/368.1, 354, 332, 160/124, 126, DIG. 18

[56] References Cited

U.S. PATENT DOCUMENTS

| | | | |
|---|---|---|---|
| 2,594,624 | 4/1952 | Dubinsky | 160/124 X |
| 3,455,366 | 7/1969 | Bogumil | 160/368.1 |
| 3,763,917 | 10/1973 | Antinone | 160/354 |
| 4,100,957 | 7/1978 | Shelton | 160/368.1 |
| 4,137,683 | 2/1979 | Pfeiffer | 160/368.1 |
| 4,188,991 | 2/1980 | Boyle | 160/124 |
| 4,673,019 | 6/1987 | Silverthorne et al. | 160/268.1 |
| 4,846,241 | 7/1989 | Chomka et al. | 160/268.1 X |
| 4,874,028 | 10/1989 | Lynch et al. | 160/126 X |
| 4,909,004 | 3/1990 | Panttila | 160/354 X |
| 5,271,449 | 12/1993 | Herrick | 160/368.1 |

*Primary Examiner*—David M. Purol

*Attorney, Agent, or Firm*—Fay, Sharpe, Beall, Fagan, Minnich & McKee

[57] ABSTRACT

A garage screen enclosure for attachment to a garage door frame having a passageway which can be opened and closed using a pair of double sided zippers. The screen or portions of the screen can be wrapped around dowel rods and suspended from the garage door frame. Devices secure the zipper so that the passageway can be locked.

18 Claims, 5 Drawing Sheets

FLEXIBLE GARAGE DOOR SCREEN

BACKGROUND OF THE INVENTION

This invention pertains to flexible screens used for enclosing a garage opening or entrance and more particularly, to garage screens configured to allow entry and exiting of the garage through the screen.

During warm weather, many homeowners seek to use their garages as an indoor patio, children's playroom, or serving area for outdoor picnics, cook outs, and the like. Unfortunately, use of garages for these purposes is often precluded because warm weather often brings out flies, wasps, mosquitos, and other pests which often disturb activities and occupants in garages. Unless equipped with screens designed to inhibit pests, homeowners cannot utilize their garages as an extra room.

In the past, garage screens have been used to protect garage occupants from pests. These screens, however, have several disadvantages including unobstructed entrance into and exit from the garage while the screen is in place. U.S. Pat. No. 3,763,917 (the '917 patent) describes a garage door screen wherein the screening material contains a single zipper for opening and closing a walk through. The walk through has a hazardous obstruction which can cause injury to those passing through it. In particular, when the walk through is opened, a portion of the screening material remains at the bottom of the opening (see FIG. 1). Unless care is exercised, the remaining portion at the bottom can cause a user to trip and fall.

Another problem associated with the '917 patent is created by use of a single zipper to open and close a walk through. As can be seen from FIG. 1 of the '917 patent, opening the walk through requires the zipper to travel along a track which rounds the corners of the flap. Unfortunately, when the zipper travels along the corner portions, the zipper is prone to jamming and may prevent users from freely entering or exiting the garage. Use of a single zipper also makes passage cumbersome, particularly when the user's hands are not free. A user must use a hand to push away the unzippered flap as it passes through the screen since the flap hangs in the passageway by one vertical edge permanently attached to the screen. If the user's hands are full, passage will be difficult.

Yet another problem associated with currently used garage door screens relates to security. Homeowners may dislike leaving garage screens attached overnight particularly when garage screens contain a walk through. Homeowners may fear that garage screens with a walk through invite a trespass or other unlawful entry. Rather than risk a trespass, many homeowners choose to remove their screen from their garage opening when the garage and the screen are not in use. Unfortunately, frequent removal can become quite burdensome.

Accordingly, a primary object of the invention is to provide a new and improved garage screen which overcomes the above referenced problems. A further object of this invention is to provide a new and improved garage screen with a passageway which allows unobstructed access to the garage. A still further object of this invention is to provide a new and improved garage screen whose passageway may be secured using a locking mechanism. Another object of this invention is to provide a garage screen which is easier to attach to garage door frames. Additional objects and advantages of the invention will be set forth in part in the description which follows and in part will be obvious from the description, or may be learned by practice of the invention. The objects of the invention may be realized by means of the instrumentalities pointed out in the appended claims.

SUMMARY OF THE INVENTION

To achieve the foregoing objects and in accordance with the purpose of the invention, as embodied and described herein, the garage screen of this invention comprises a flexible mesh-like material with dimensions substantially similar to a particular garage opening and having a flap created by a pair of vertical cuts which start at the bottom of the screen. A fastener, such as strips of hooks and loops sold under the trademark (VELCRO ®) is used for attaching the perimeter of the screen to the garage opening. Velcro ® is used so that the sides of the screen are quickly and easily detached from the garage door frame. Double sided zippers are sewn into the vertical cuts for opening and closing the adjacent edges formed by the cuts. Locks are provided for securing the zippers and prohibiting the adjacent edges from being opened. Hems sewn into the bottom of the screen are used for holding dowel rods which in turn are used to weight the bottom edge of the screen thereby keeping it in contact with the garage floor, and to act as a type of spindle around which the screen may be wrapped. Lastly, supporting straps with hooks are attached to the screen for suspending the whole screen or portions of the screen from the garage frame top when the screen or a portion thereof is in a rolled up configuration.

As an alternative to the embodiment having a flap, the foregoing objects can be achieved with a screen comprising three separate panels formed by cutting the flexible mesh-like material along two parallel lines. Two double sided zippers and tracks are then sewn into the edges of the newly formed edges and are used for reattaching the panels. Locks are provided for securing the zippers and prohibiting the panels from being detached. A fastener such as (VELCRO ®) is used for attaching the perimeter of the screen combination to the garage opening. Hems sewn into each panel hold dowel rods which in turn are used to weight the bottom edge of the screen and act as a spindle around which the screen may be wrapped. Lastly, supporting straps are attached to the screen with hooks for suspending one or more of the panels from the garage frame top when one or more of the panels is in a rolled up configuration.

Preferably, the garage door screen can be formed from a fiber glass mesh with a grid spacing wide enough to pass air and smoke but narrow enough to inhibit mosquitos, flies, and other pests. The horizontal length of the screen should be substantially equal to the horizontal length of the garage door opening, and the vertical length should be longer than the vertical length of the garage door opening. Overall, the dimensions of the garage door screen should equal the dimensions of the garage door opening. The length added to the vertical height is used to compensate for unevenness in the garage floor such that the screen completely and securely covers the garage floor thereby blocking entry of insects or small animals.

BRIEF DESCRIPTION OF THE DRAWINGS

The drawings herein are only for the purpose illustrating a preferred embodiment of the invention and are not to be construed as limiting the invention. In the drawings.

DETAILED DESCRIPTION OF THE PREFERRED EMBODIMENTS

Figure 1:
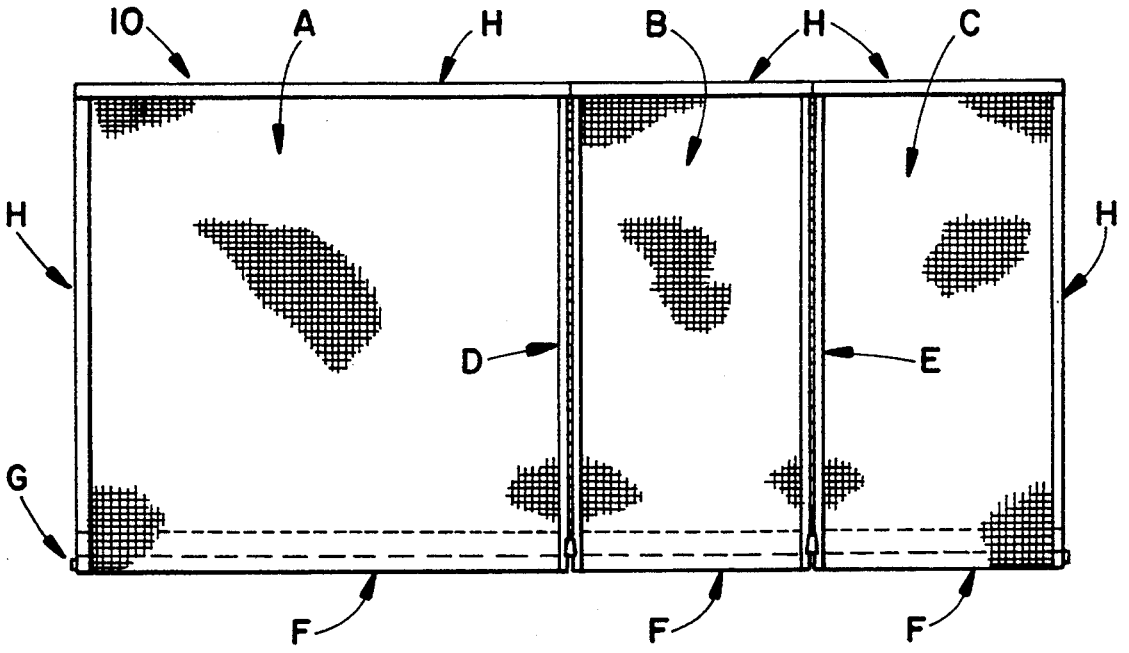
FIG. 1 is a front view of the garage door screen enclosure in accordance with the present invention with the screen in a deployed position.
Figure 2:
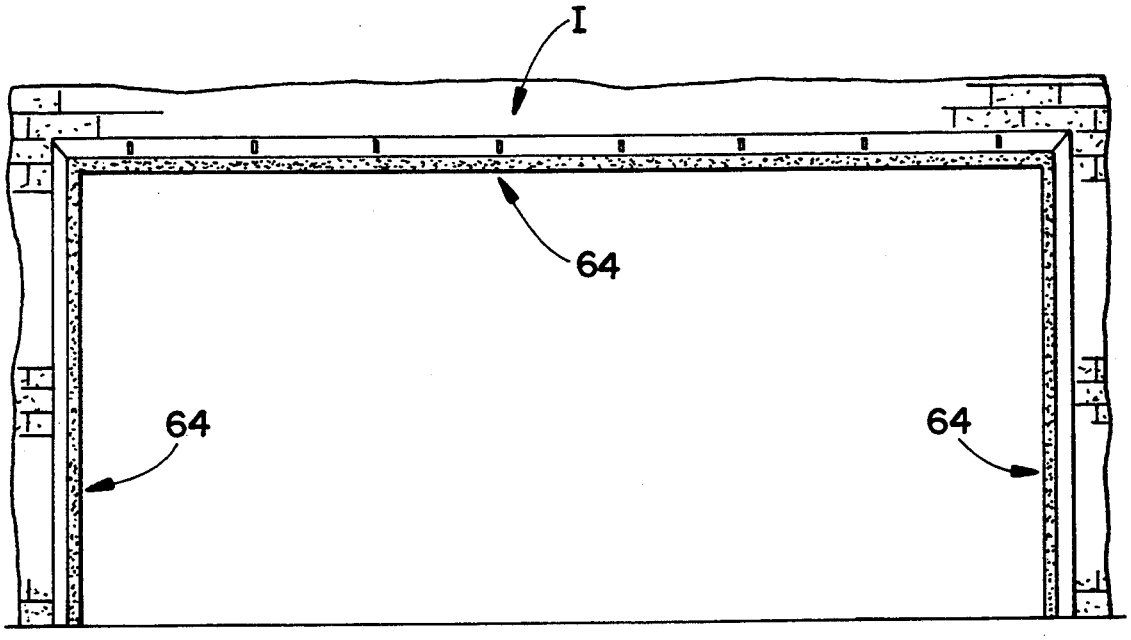
FIG. 2 depicts a garage door frame opening on which the garage door screen enclosure is attached.
Figure 3:
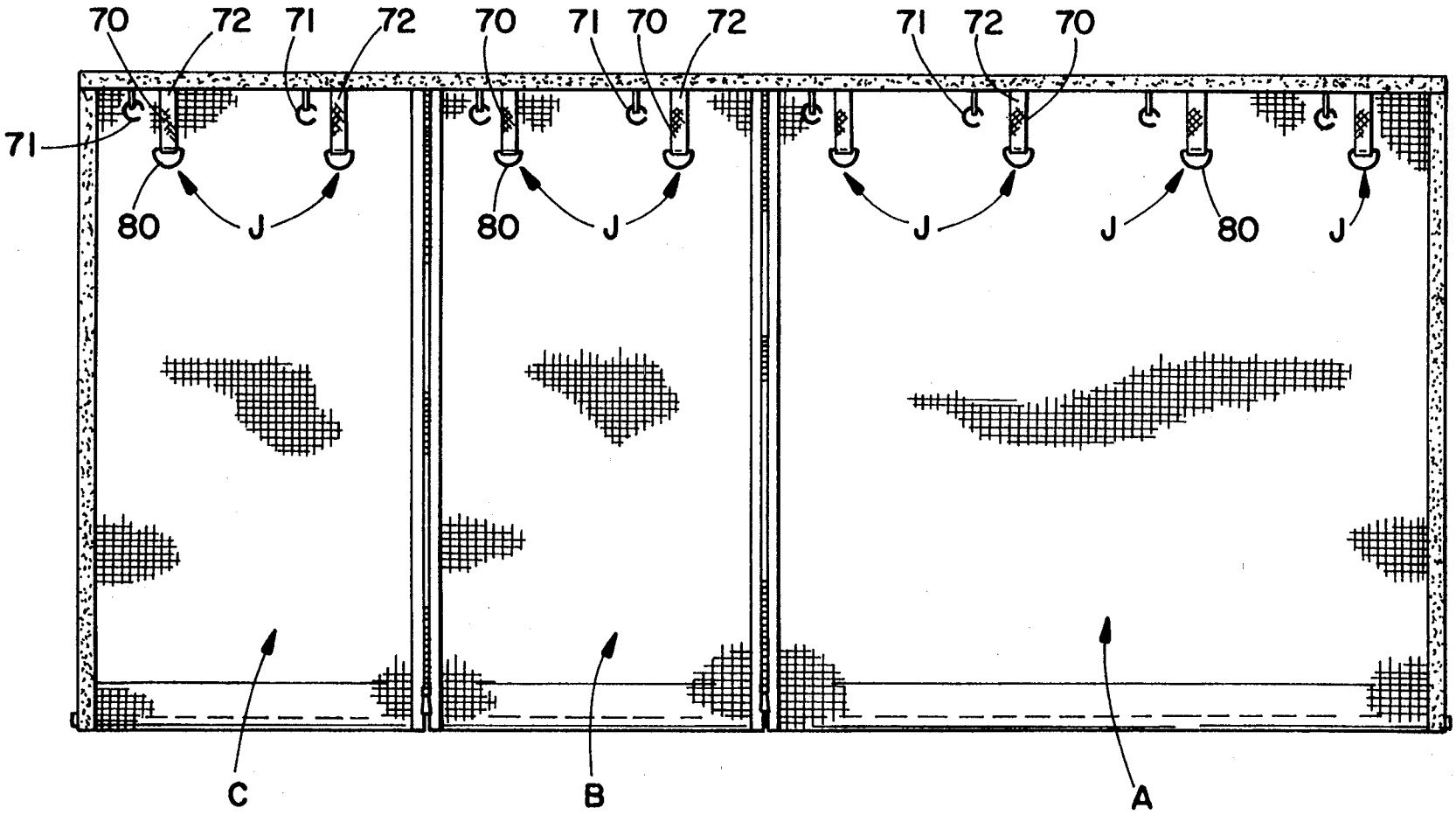
FIG. 3 is a rear view of the garage door screen of FIG. 1.

Referring now to the drawings, wherein the showings are made for the purposes of illustrating a preferred embodiment of the invention only and not for the purposes of limiting same, FIG. 1 depicts the flexible garage screen enclosure 10 according to the present invention and includes three panels A, B, and C. The panels are formed of a lightweight and flexible mesh-like material and are connected to each other by fasteners D and E sewn into the edges of the panels as shown. Hems F are also sewn into panels A, B, and C and hold dowel rods G. Also sewn into the panels are fasteners H which are used to connect the screen enclosure to a garage door frame I as shown in FIG. 2. As disclosed in FIG. 3, supporting straps J are attached to the rear side of the panels and are used for supporting the panels A, B, and C from the garage frame when either one or all of the panels are in a rolled up configuration.

With continuing reference to FIG. 1, the garage door enclosure 10 is made from a flexible mesh-like material with a grid spacing wide enough to pass air and smoke but narrow enough to inhibit the passage of mosquitos, flies, and other pests. Fiber glass mesh and nylon mesh are types of materials well suited for this purpose.

A rectangular piece of the mesh material is formed with dimensions substantially equal to the garage door frame I (see FIG. 2). The rectangular piece is formed with a width equal to the width of the garage opening and a height approximately six inches greater than the height of the garage opening. The extra six inches is needed to form hems F and to compensate for unevenness in the garage floor. The extra length also allows the bottom portion of the screen to lay flush with the garage floor to eliminate any small openings which would otherwise allow insects or small animals to enter the garage.

Figure 4:
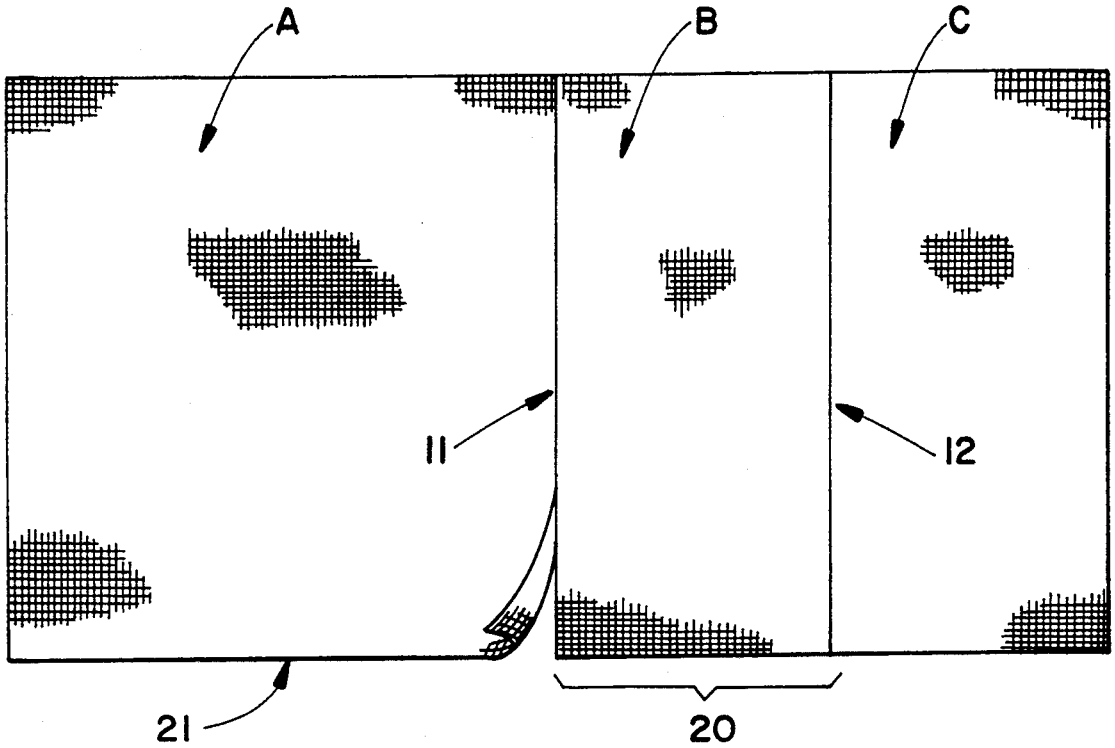
FIG. 4 depicts the screen severed into three panels in accordance with a preferred embodiment.

Referring to FIG. 4, panels A, B, and C are constructed from the rectangular piece of mesh by cutting along parallel lines 11 and 12 extending vertically from the bottom edge 20. The width of panel B is such that when all panels are fastened to the garage door frame, and B is rolled up and supported from the upper portion of the frame, the opening created is wide enough to allow unobstructed adult ingress and egress.

Figure 5:
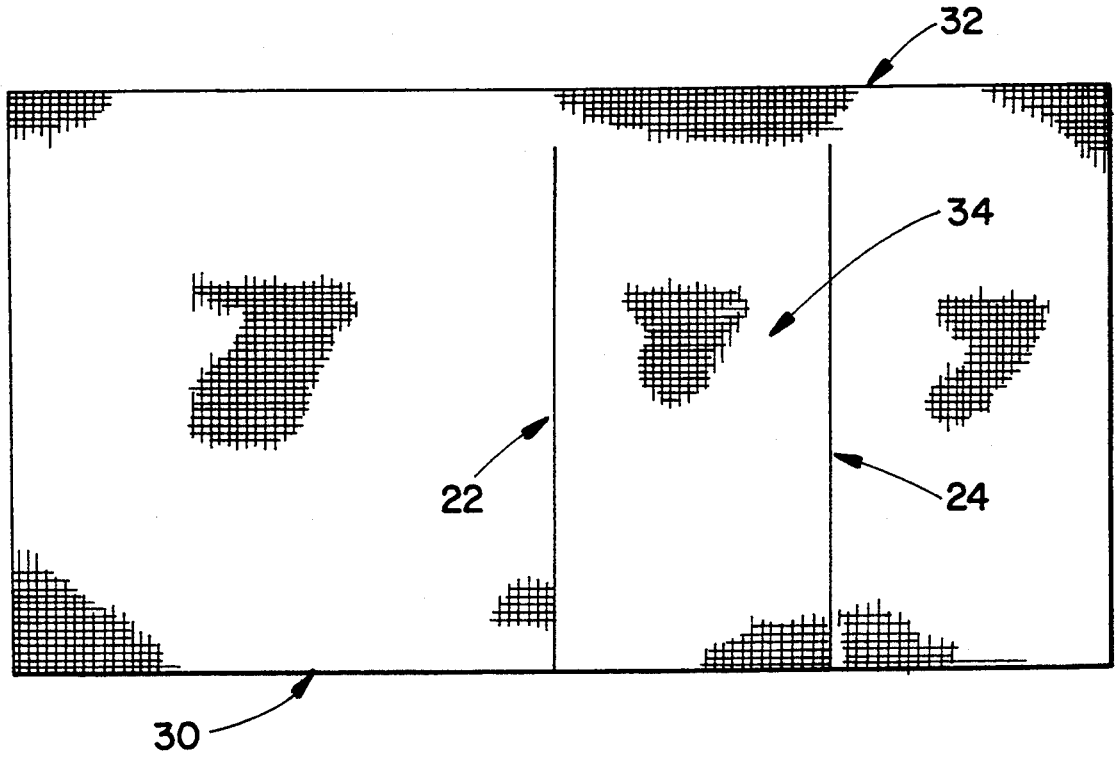
FIG. 5 shows the screen with two vertical parallel cuts made in accordance with a preferred embodiment.

In the alternative embodiment shown in FIG. 5, the rectangular piece of mesh is cut along parallel lines 22 and 24 starting from the bottom edge 30. Unlike the vertical cuts shown in FIG. 4, vertical cuts 22 and 24 do not sever the rectangular piece of mesh into separate panels. The vertical cuts 22 and 24 shown in FIG. 5 do not extend to the top of the screen. The cuts along lines 22 and 24 are separated by a width equal to that which would allow an adult to move through the screen when the screen is attached to the garage door frame and when the flap 34, created by the vertical cuts, is held in a rolled up position within one inch of the top. Also, the length of the vertical cuts 22 and 24 are at least as long as the height of an average adult. The width, length, and location of the flap 34 is alterable according to the particular requirements of the installation. The edges of both embodiments are finished to make the garage screen strong and durable.

Figure 6:
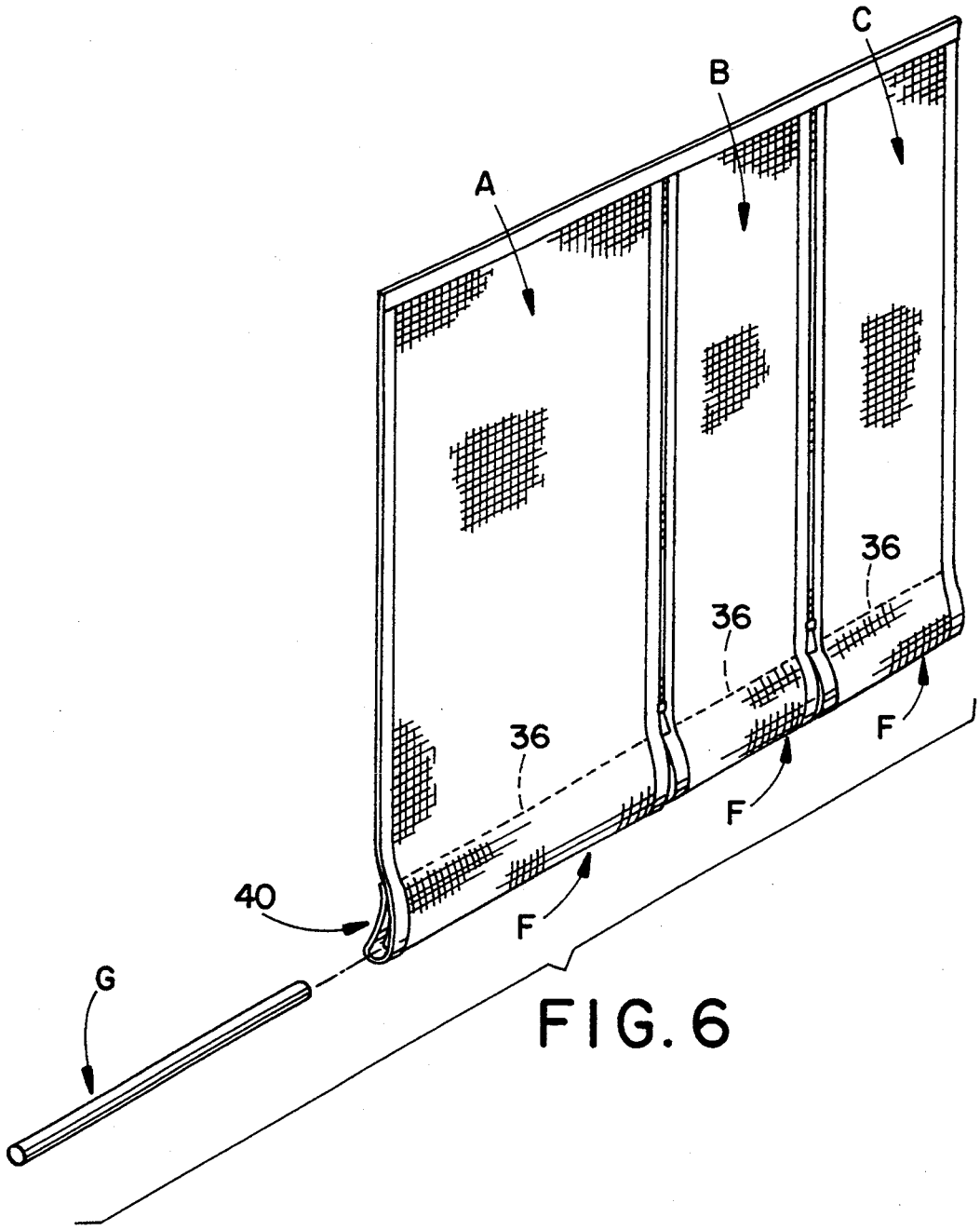
FIG. 6 is a side view of the hem formed at the bottom of the garage door screen.
Figure 7:
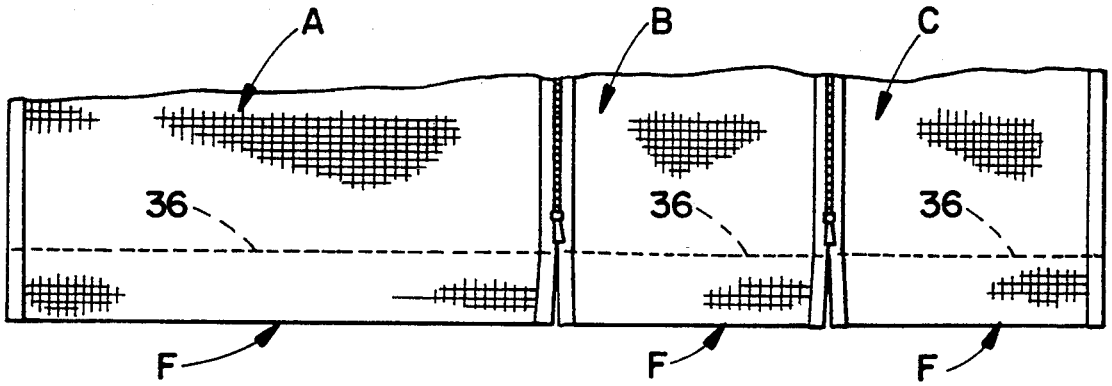
FIG. 7 is a front view of the hems formed at the bottom of the garage door screen.

As shown in FIG. 6, hems F are formed by folding back and sewing along horizontal line 36 the bottom edges of the panels A, B, and C of FIG. 4 or the bottom edge 30 of the screen shown in FIG. 5. Horizontal line 36 is located on the rear side of the screen as shown in FIG. 7. FIG. 6 is a side view of the lower portion of the screen and shows a side view of hem F formed by sewing the bottom edge 21 or 30 to the rear side of the screen material. As can be seen in FIG. 6, the hems F are opened at either end for inserting weighting objects such as dowel rods G.

The dowel rods can be used as a type of spindle around which the flexible mesh-like material may be wrapped and stored. The three hems, sewn into the bottom of the screen, contain three separate dowel rods. In addition to acting as a weight to keep the bottom of the screen in contact with the floor of the garage, the screen may be wrapped around the dowel rods and be suspended from the garage frame top using the hooks and straps described later. When the screen is rolled up and suspended, cars can exit and enter the garage without interference. Moreover, the rolled up screen can be suspended from the garage frame so that the screen is not an obstacle to opening or closing the garage door. Similarly, the flap or any panel may be wrapped around a dowel rod and suspended from the garage frame top while the remaining positions of the screen are attached to the garage frame sides. For example, the panel B, once unzipped from the rest of the screen, can be wrapped around the middle dowel G, and the resulting roll may then be suspended from the garage frame top using straps and hooks provided. Once the panel B is suspended in this manner, an unobstructed passageway is formed which allows quick and easy access to the garage.

Figure 8:
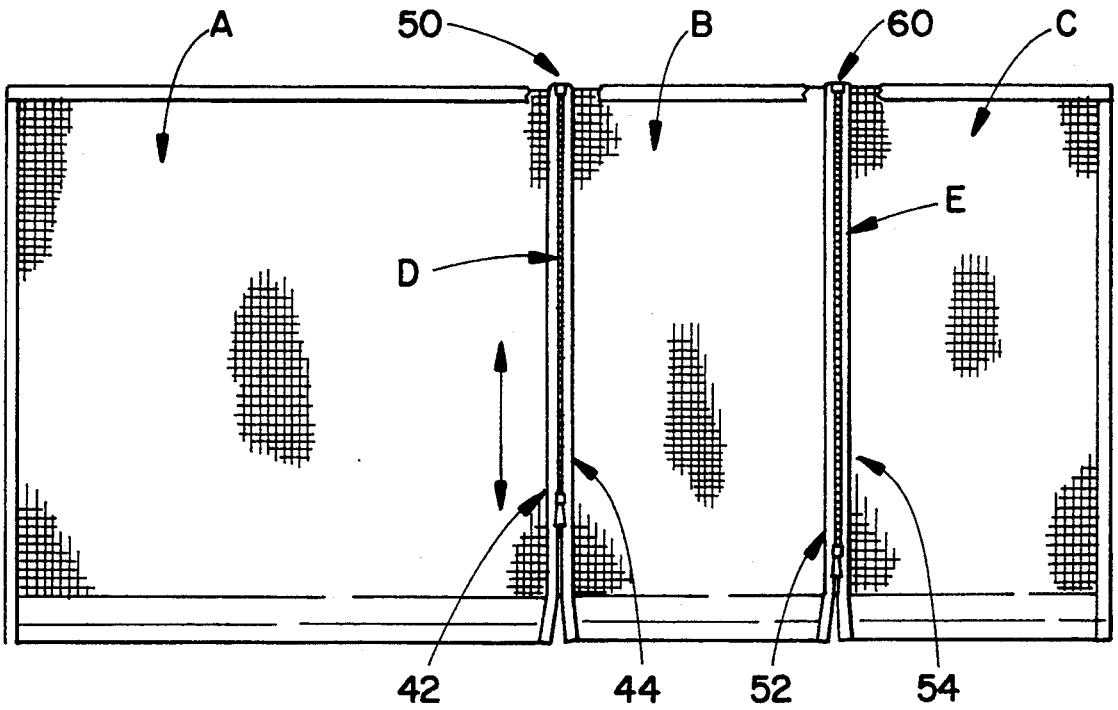
FIG. 8 depicts the double sided zippers sewn into the garage door screen.

FIG. 8 shows fasteners D and E which are used to attach panel A to panel B and panel C to panel B. The fastener means D ideally consists of a first track 42 sewn into the right edge of panel A, a second track 44 sewn into the left edge of panel B, and a double zipper 50 which, when travelled along the tracks 42 and 44, attach or detach panels A and B. The second fastener means E ideally consists of a first track 52 which is sewn into the right edge of panel B, a second track which is sewn into the left edge of panel C, and a double sided zipper 60 which, when travelled along the tracks 52 and 54, attach and detach panels B and C.

Double zippers are used so the passageway can be opened and closed from either the garage interior or the garage exterior. The double zipper has two handles, and when the garage screen is attached to the frame the zipper can be moved from the garage exterior using the first handle, or the zipper may be moved from the interior using the second handle. The double sided zipper makes it easier to open and close the screen passageway.

The screen is removably attached to the garage door frame using a fastening means. There is provided as shown in FIG. 1, first mating means H sewn, glued, cemented, or otherwise attached onto the left and upper edges of panel A, the upper edge of panel B and the right and upper edges of panel C. A single piece of mating means can also be attached to the upper edges of panels A, B, and C so that the separated panels as shown in FIG. 4 can be reattached at the top to form an integrated garage door screen. In FIG. 2 second mating means 64 are permanently adhered to the perimeter of the garage door frame I. The second mating means 64 are glued, cemented, or otherwise bonded to the garage door frame I. In the preferred construction of the mating means H consist of self-gripping hook and loop-type strips commonly known as Velcro®. Connecting and removing the garage door screen from the frame is quicker and easier when Velcro® is used as the fastener. Snaps and zippers are also well suited as fastener means.

Returning attention to FIG. 3, there is shown attached to the screen several straps J consisting of nylon strips 70 which have one end 72 sewn into the rear side of the screen and a second end to which is attached a ring 80 made of metal or plastic. Several straps are attached to each of the panels A, B, and C and are used to suspend the panels when they are in a rolled up position either individually or in combination while the garage door screen is attached to the garage door frame. If a walk-through is desired to be formed, the edges of panel B are detached from the edges of panel C and A, and panel B can be rolled up starting from the bottom. When panel B is rolled to the point at which the straps J are connected to the screen, the straps J can be wrapped underneath the ring 80 and inserted into a C-hook 71 inserted into the upper edge of the garage door frame I. As a result, while the garage door screen is attached to the garage door frame, an unobstructed walk through can be formed when the panel B is in the rolled up position.

Figure 9:
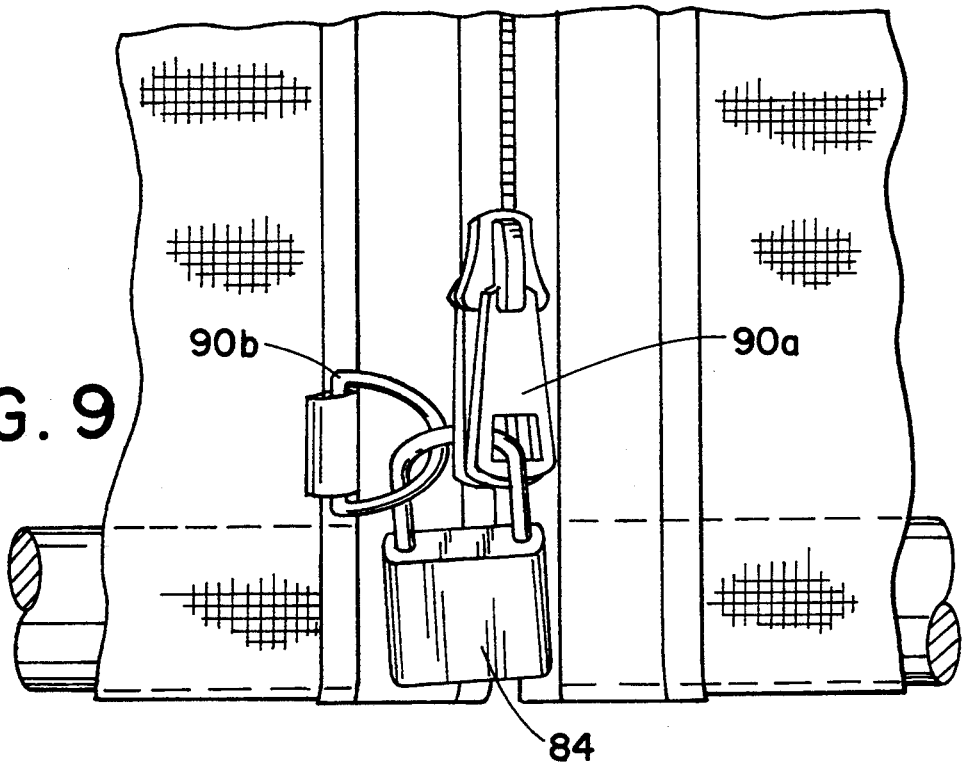
FIG. 9 shows the locking mechanism used to secure the screen passageway.

Locking the passageway prohibits garage entrance through the garage door screen. A locking device consisting of a pad lock 84 and loops **90*a*, 90*b* permanently attached to the zippers and bottom edges of the screen, is shown in FIG. 9. When the zipper loop is fastened to the bottom edge loop 90*b*** using the padlock, the flap or middle panel cannot be opened.

The loops have an inner diameter greater than the diameter of the U-shaped bar of the padlock. The zipper loop and the bottom edge loop are fastened together by closing the U-shaped bar after the bar is threaded through these loops. Once fastened to the bottom edge loop, the zipper cannot be moved and the flap or middle panel remains temporarily locked.

The bottom edge loops are attached to the screen near the bottom edge of the flap or middle panel. When the passageway is completely closed, the zipper loops are located closely to the bottom edge loops. With this configuration, the loops are easily fastened together with the padlock.

From the foregoing, it is to be appreciated that the invention provides for an externally mounted garage door screen which is adaptable to garage door openings of multiple dimensions. The garage door screen prevents insects and other pests and small animals from entering the garage and thereby allows homeowners to use their garage as an extra room which is reasonable ventilated during the warm weather.

While the invention has been described with respect to its presently preferred embodiment, it is to be appreciated further that changes may be made thereto by those of skill in the art without departing from the spirit and scope thereof. Accordingly, the following claims should be interpreted to include all those equivalent embodiments within the spirit and scope thereof.

What is claimed is:

1. An apparatus, comprising:

a garage door frame having a first vertical edge, a second vertical edge, and a horizontal edge;

a first panel of flexible mesh material;

a second panel of flexible mesh material;

a third panel of flexible mesh material;

a first fastening means for fastening a first edge of the first panel to the first vertical edge of the garage door frame;

a second fastening means for fastening a second edge of the first panel to the horizontal edge of the garage door frame;

a third fastening means for fastening a third edge of the first panel to the first edge of the second panel;

a fourth fastening means for fastening a second edge of the second panel to the horizontal edge of the garage door frame;

a fifth fastening means for fastening a third edge of the second panel to a first edge of the third panel;

a sixth fastening means for fastening a second edge of the third panel to the horizontal edge of the garage door frame;

a seventh fastening means for fastening a third edge of the third panel to the second vertical edge of the garage door frame;

a first means for suspending the first panel from the garage door frame when the first panel is in a rolled up configuration;

a second means for suspending the second panel from the garage door frame when the second panel is in a rolled up configuration; and a third means for suspending the third panel from the garage door frame when the third panel is in a rolled up configuration.

2. The apparatus of claim 1, further comprising:

a first hem fixedly attached to a fourth edge of the first panel;

a second hem fixedly attached to a fourth edge of the second panel; and a third hem fixedly attached to a fourth edge of the third panel.

3. The apparatus of claim 2, further comprising:

a first weighting means removably inserted into the first hem;

a second weighting means removably inserted into the second hem; and a third weighting means removably inserted into the third hem.

4. The apparatus of claim 1 further comprising:

a first locking means connected to the third fastening means, for selectively locking the third edge of the first panel to the first edge of the second panel; and a second locking means connected to the fifth fastening means, for selectively locking the third edge of the second panel to the first edge of the third panel.

5. The apparatus of claim 1 wherein each of the first, second, fourth, sixth, and seventh fastening means further comprise a plurality of hooks and a plurality of loops.

6. An apparatus, comprising:

a garage door frame;

a sheet of flexible screening material, having a first pair of parallel adjacent edges and a second pair of parallel adjacent edges;

a perimeter fastening means for releasably fastening the sheet to the garage door frame;

a first fastening means for releasably fastening the first pair of parallel adjacent edges;

a second fastening means for releasably fastening the second pair of parallel adjacent edges; and a means for suspending the sheet from the garage door frame while said sheet is in a rolled up configuration.

7. The apparatus according to claim 6 further comprising a first locking means connected to the first fastening means, for selectively locking the first pair of parallel adjacent edges.

8. The apparatus according to claim 7 further comprising a second locking means connected to the second fastening means, for selectively locking the second pair of parallel adjacent edges.

9. The apparatus according to claim 6 further comprising a hem fixedly attached to the sheet, for holding a dowel rod.

10. The apparatus according to claim 6 wherein:

the first fastening means comprises a first pair of zipper rows and a first zipper; and the second fastening means further comprises a second pair of zipper rows and a second zipper.

11. The apparatus according to claim 6 wherein the perimeter fastening means further comprises a strip of hooks and a matable strip of loops.

12. The apparatus according to claim 7 wherein the first locking means further comprises a first loop fixedly attached to the sheet and a first padlock.

13. The apparatus according to claim 8 wherein the second locking means further comprises a second loop fixedly attached to the sheet and a second padlock.

14. The apparatus according to claim 6 wherein the means for suspending further comprises a strap with first and second ends, a hook and a loop wherein the first end of the loop is attached to the sheet, the loop is attached to the second end and the hook is attached to a horizontal portion of the garage door frame.

15. The apparatus according to claim 6 wherein:

the first fastening means comprises a first strip of loops and a second strip of hooks; and the second fastening means comprises a second strip of loops and a second strip of hooks.

16. An apparatus comprising:

a garage door frame having a strip of hooking fabric attached to the frame's perimeter;

a sheet of flexible screening material forming a generally rectangular shaped garage screen attached to the garage door frame with a strip of looping fabric attached to the screening material perimeter, the garage screen having a length substantially greater than the garage door frame wherein a bottom portion of the screening material lies on a ground surface beneath the garage door frame;

a pair of double sided zippers attached to the screening material to form a doorway opening thereby forming at least three separate portions of the bottom portion of the screening material;

a hem consisting of at least three portions, formed at the bottom edge of the screening material; and a plurality of dowel rods received in the hem.

17. The apparatus of claim 16, further comprising a strap and ring attached to the screening material for suspending the screening material defined between the pair of double sided zippers in a rolled up configuration.

18. The apparatus of claim 16 further comprising a plurality of locks to lock the doorway.

* * * * *